US010204557B2

(12) United States Patent
Song et al.

(10) Patent No.: US 10,204,557 B2
(45) Date of Patent: Feb. 12, 2019

(54) ACTIVE-MATRIX ORGANIC LIGHT EMITTING DIODE (AMOLED) DISPLAY APPARATUS AND BRIGHTNESS COMPENSATION METHOD THEREOF

(71) Applicant: BOE TECHNOLOGY GROUP CO., LTD., Beijing (CN)

(72) Inventors: Danna Song, Beijing (CN); Zhongyuan Wu, Beijing (CN); Szu Heng Tseng, Beijing (CN); Song Meng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/307,611

(22) PCT Filed: Jan. 13, 2016

(86) PCT No.: PCT/CN2016/070744
§ 371 (c)(1),
(2) Date: Oct. 28, 2016

(87) PCT Pub. No.: WO2017/031929
PCT Pub. Date: Mar. 2, 2017

(65) Prior Publication Data

US 2017/0193909 A1 Jul. 6, 2017

(30) Foreign Application Priority Data

Aug. 26, 2015 (CN) ..... 2015 1 0531737

(51) Int. Cl.
*G09G 3/3258* (2016.01)
*G09G 3/20* (2006.01)
*G09G 3/3233* (2016.01)

(52) U.S. Cl.
CPC ..... *G09G 3/3258* (2013.01); *G09G 3/2074* (2013.01); *G09G 3/3233* (2013.01);
(Continued)

(58) Field of Classification Search
None
See application file for complete search history.

(56) References Cited

U.S. PATENT DOCUMENTS

2009/0256854 A1 10/2009 Mizukoshi et al.

FOREIGN PATENT DOCUMENTS

CN 101937644 A 1/2011
CN 102663976 A 9/2012
(Continued)

OTHER PUBLICATIONS

International Search Report and Written Opinion dated May 4, 2016; PCT/CN2016/070744.
(Continued)

*Primary Examiner* — Matthew Yeung
(74) *Attorney, Agent, or Firm* — Ladas & Parry LLP

(57) ABSTRACT

An Active-Matrix Organic Light Emitting Diode (AMOLED) display apparatus and a brightness compensation method thereof are provided. At an initial compensation stage, a display screen can be subjected to brightness calibration by an image sensor so as to acquire a data voltage compensation value of each sub-pixel when a brightness value of a display panel equals a preset value, a first data voltage is output to a corresponding pixel circuit according to the data voltage compensation value of each sub-pixel, a sensed voltage of each sub-pixel at this stage is used as an initial reference voltage of each sub-pixel when the brightness value of the display panel equals the preset value; and at a subsequent compensation stage, by regulating a data voltage of each sub-pixel, the sensed voltage of each sub-
(Continued)

pixel is made to be equal to the corresponding initial reference voltage when the brightness value of the display panel equals the preset value, so as to achieve uniform compensation on brightness of each sub-pixel at the subsequent compensation stage. Thus, not only are uniformity and accuracy of initial brightness compensation improved, but also pixel aging is accurately compensated and uniformity and accuracy of subsequent compensation are improved.

11 Claims, 1 Drawing Sheet

(52) U.S. Cl.
CPC ... *G09G 2310/027* (2013.01); *G09G 2310/08* (2013.01); *G09G 2320/0233* (2013.01); *G09G 2320/0295* (2013.01); *G09G 2320/043* (2013.01); *G09G 2320/0626* (2013.01); *G09G 2330/12* (2013.01); *G09G 2360/147* (2013.01)

(56) References Cited

FOREIGN PATENT DOCUMENTS

| | | | |
|---|---|---|---|
| CN | 102968954 | A | 3/2013 |
| CN | 103021335 | A | 4/2013 |
| CN | 103489405 | A | 1/2014 |
| CN | 104021759 | A | 9/2014 |
| CN | 104064156 | A | 9/2014 |
| CN | 105096834 | A | 11/2015 |

OTHER PUBLICATIONS

First Chinese Office Action dated Nov. 4, 2016; Appln. No. 201510531737.0.

ACTIVE-MATRIX ORGANIC LIGHT EMITTING DIODE (AMOLED) DISPLAY APPARATUS AND BRIGHTNESS COMPENSATION METHOD THEREOF

TECHNICAL FIELD

Embodiments of the present disclosure relate to an Active-Matrix Organic Light Emitting Diode (AMOLED) display apparatus and a brightness compensation method thereof.

BACKGROUND

An Active-Matrix Organic Light Emitting Diode (AMOLED) display apparatus is a self-luminous element based on Organic Light Emitting Diodes (OLEDs). The light emitting principle of each OLED is that an organic semiconductor material and a light emitting material are subjected to carrier injection and compounding under the drive of an electric field so as to emit light. Due to various advantages of high brightness, high image quality, ultra small thickness, good display efficiency and the like, the AMOLED display apparatus is hopeful to be more widely applied.

The AMOLED display apparatus consists of thousands of pixels, and each pixel includes an OLED and a pixel circuit for driving the OLED. Each pixel circuit consists of a switching Thin-Film Transistor (TFT), a capacitor and a drive TFT. Each switching TFT charges a voltage corresponding to a data signal to the corresponding capacitor, the corresponding drive TFT regulates a current supplied to the corresponding OLED according to the voltage of the capacitor, and a luminous quantity of the OLED is in direct proportion to the current, so that brightness of the OLED is regulated.

However, due to imperfect process and the like, the drive TFTs of all the pixels have specific differences in threshold voltage $V_{th}$, and migration rate so as to cause different currents of all the pixels, which are used for driving the OLEDs, and brightness distortions among all the pixels. A visual result is that the original specific differences of the drive TFTs cause spots or patterns on a screen, and in the subsequent driving process, the drive TFTs can reduce the service life of an AMOLED display panel or generate image retention due to the specific differences generated by degradation.

In order to solve this problem, the Chinese Patent CN102968954A discloses an AMOLED display apparatus capable of rapidly sensing a current of each pixel so as to compensate the brightness distortions among the pixels, and a method for sensing the current of each pixel of the AMOLED display apparatus. According to this patent, parasitic capacitors (i.e., line capacitors) on column-oriented lines (e.g., datum lines, data lines or first power lines and the like) on a display screen are utilized, the parasitic capacitors are charged by currents of the drive TFTs, voltages obtained after charging are input into an Analog-to-Digital Converter (ADC) module, and then the currents of the pixels are calculated by utilizing a formula $I=Cx(V2-V1)/(t2-t1)$.

However, due to limitations of process, e.g., an uneven film-forming thickness and the like, the capacitors of all the column-oriented lines on the display screen may be different, and moreover, the ADC module in an integrated circuit has an error for conversion of each channel, both of which can influence sensing of the currents so as to cause inaccurate compensation on the brightness distortions of the pixels.

SUMMARY

Embodiments of the present invention provide An Active-Matrix Organic Light Emitting Diode (AMOLED) display apparatus, comprising a display panel, the display panel comprises a plurality of sub-pixels, each sub-pixel comprises an Organic Light Emitting Diode (OLED) and a pixel circuit for independently driving the OLED, and the AMOLED display apparatus further comprising: a drive chip, configured to output a data voltage corresponding to each sub-pixel and acquire a sensed voltage corresponding to each sub-pixel; and a Timing Controller (ICON), configured to: at an initial compensation stage, acquire a corresponding data voltage compensation value when brightness of all the sub-pixels is uniform and consistent under a condition that a brightness value of the display panel is a preset value, by regulating an initial data voltage output to each sub-pixel by the drive chip, control the drive chip to output a first data voltage to the pixel circuit of each sub-pixel according to the data voltage compensation value corresponding to each sub-pixel, acquire a sensed voltage corresponding to each sub-pixel at this stage by the drive chip, and set each sensed voltage as an initial reference voltage corresponding to each sub-pixel under the condition that the brightness value of the display panel equals the preset value; and at a subsequent compensation stage, by changing the data voltage output to each sub-pixel by the drive chip, make the sensed voltage corresponding to each sub-pixel to be equal to the initial reference voltage corresponding to each sub-pixel under the condition that the brightness value of the display panel equals the preset value, so as to achieve uniform compensation on brightness of each sub-pixel at the subsequent compensation stage; wherein the brightness of each sub-pixel is measured by an image sensor.

In an embodiment of the present invention, for example, the brightness includes a gray scale or display brightness.

In an embodiment of the present invention, for example, for any one sub-pixel, the data voltage compensation value corresponding to the any one sub-pixel includes: a first data voltage of the any one sub-pixel when the brightness of all the sub-pixels is uniform and consistent; or a difference value or a proportional value of the first data voltage and the initial data voltage output to the any one sub-pixel by the drive chip.

In an embodiment of the present invention, for example, the drive chip includes a Digital-to-Analog Converter (DAC) module and an Analog-to-Digital Converter (ADC) module; the DAC module is configured to output the data voltage corresponding to each sub-pixel; and the ADC module is configured to detect the sensed voltage corresponding to each sub-pixel.

In an embodiment of the present invention, for example, for any one sub-pixel, the sensed voltage corresponding to the any one sub-pixel equals a voltage for a drive thin film transistor (TFT) in the pixel circuit of the any one sub-pixel to charge a line capacitor.

In an embodiment of the present invention, for example, the TCON is further configured to: at any one moment, when the brightness value of the display panel is not equal to the preset value, for any one sub-pixel, carry out an interpolation operation by utilizing at least two groups of standard reference data related to the any one moment, calculate the data voltage which needs to be output to the pixel circuit of the any one sub-pixel at the any one moment, and control the drive chip to drive the pixel circuit of the any one sub-pixel according to the calculated data voltage, wherein each group of standard reference data related to the any one moment includes: a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value.

Embodiments of the present invention provide a brightness compensation method of an Active-Matrix Organic Light Emitting Diode (AMOLED) display apparatus, comprising: at an initial compensation stage, by a TCON, acquiring a data voltage compensation value corresponding to each sub-pixel when a brightness of all the sub-pixels is uniform and consistent under a condition that a brightness value of a display panel is a preset value, by regulating an initial data voltage output to each sub-pixel by a drive chip, controlling the drive chip to output a first data voltage to a pixel circuit corresponding to each sub-pixel according to the data voltage compensation value corresponding to each sub-pixel, acquiring a sensed voltage corresponding to each sub-pixel at this stage by the drive chip, and setting each sensed voltage as an initial reference voltage corresponding to each sub-pixel under a condition that the brightness value of the display panel equals the preset value; and at a subsequent compensation stage, by the ICON, by changing the data voltage output to each sub-pixel by the drive chip, making the sensed voltage corresponding to each sub-pixel to be equal to the initial reference voltage corresponding to each sub-pixel under the condition that the brightness value of the display panel equals the preset value, so as to achieve uniform compensation on brightness of each sub-pixel at the subsequent compensation stage; wherein the brightness of each sub-pixel is measured by an image sensor.

In an embodiment of the present invention, for example, in the method, the brightness includes a gray scale or display brightness.

In an embodiment of the present invention, for example, in the method, for any one sub-pixel, the data voltage compensation value corresponding to the any one sub-pixel includes: a first data voltage of the any one sub-pixel when the brightness of all the sub-pixels is uniform and consistent; or a difference value or a proportional value of the first data voltage and the initial data voltage output to the any one sub-pixel by the drive chip.

In an embodiment of the present invention, for example, in the method, for any one sub-pixel, the sensed voltage corresponding to the any one sub-pixel equals a voltage for a drive thin film transistor (TFT) in the pixel circuit of the any one sub-pixel to charge a line capacitor.

In an embodiment of the present invention, for example, in the method, at any one moment, when the brightness value of the display panel is not equal to the preset value, for any one sub-pixel, carrying out an interpolation operation by utilizing at least two groups of standard reference data related to the any one moment, calculating the data voltage which needs to be output to the pixel circuit of the any one sub-pixel at the any one moment, and controlling the drive chip to drive the pixel circuit of the any one sub-pixel according to the calculated data voltage, wherein each group of standard reference data related to the any one moment includes: a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value.

BRIEF DESCRIPTION OF THE DRAWINGS

In order to clearly illustrate the technical solution of the embodiments of the disclosure, the drawings of the embodiments will be briefly described in the following, it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiment will be described in a clearly and fully understandable way in connection with the drawings related to the embodiments of the disclosure. It is obvious that the described embodiments are just a part but not all of the embodiments of the disclosure. Based on the described embodiments herein, those skilled in the art can obtain other embodiment(s), without any inventive work, which should be within the scope of the disclosure.

Embodiment I

Figure 1:
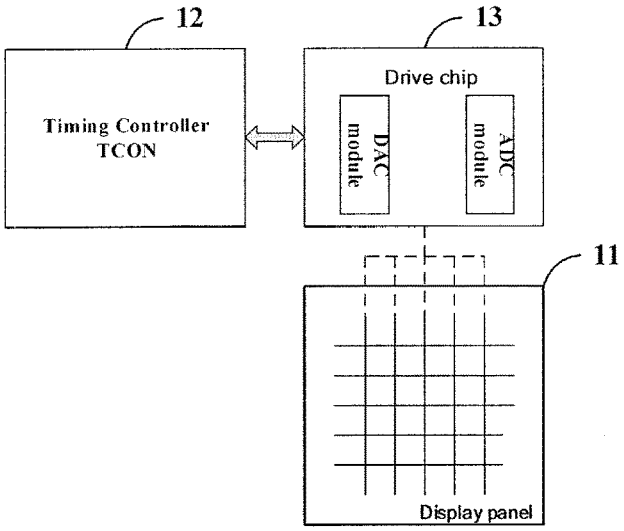
FIG. 1 shows a structural schematic diagram of an Active-Matrix Organic Light Emitting Diode (AMOLED) display apparatus in an embodiment of the present disclosure.

Embodiment I of the present disclosure provides an Active-Matrix Organic Light Emitting Diode (AMOLED) display apparatus. FIG. 1 is a structural schematic diagram of the AMOLED display apparatus in Embodiment I of the present disclosure. The AMOLED display apparatus includes a display panel 11, a Timing Controller (TCON) 12 and a drive chip 13, wherein The display panel 11 includes a plurality of sub-pixels (for example, each sub-pixel is defined by transverse gate lines and longitudinal data lines intersecting with each other in the diagram), and each sub-pixel includes an Organic Light Emitting Diode (OLED) and a pixel circuit for independently driving the OLED; and the pixel circuit, for example, can include devices such as a drive transistor, a switching transistor, a capacitor and the like. The OLED device can emit white light or monochromatic light, e.g., red light, green light, blue light and the like.

The drive chip 13 can be used for outputting a data voltage corresponding to each sub-pixel, and acquiring a sensed voltage corresponding to each sub-pixel;

At an initial compensation stage, by the TCON 12, an initial data voltage output to each sub-pixel by the drive chip 13 is regulated, a data voltage compensation value corresponding to each sub-pixel when brightness of all the sub-pixels is uniform and consistent under a condition that a brightness value of the display panel equals a preset value is acquired, the drive chip 13 is controlled to output a first data voltage to the pixel circuit of each sub-pixel according to the data voltage compensation value corresponding to each sub-pixel, the sensed voltage corresponding to each sub-pixel at this stage is acquired by the drive chip 13, and each sensed voltage is set as an initial reference voltage corresponding to each sub-pixel under the condition that the brightness value of the display panel equals the preset value;

and at a subsequent compensation stage, by changing the data voltage output to each sub-pixel by the drive chip 13, the sensed voltage corresponding to each sub-pixel is made to be equal to the initial reference voltage corresponding to each sub-pixel when the brightness value of the display panel equals the preset value, so as to achieve uniform compensation on brightness of each sub-pixel at the subsequent compensation stage, wherein the brightness of each sub-pixel, for example, can be measured by an image sensor, e.g., a Charge Coupled Device (CCD) (i.e., a display screen is photographed by using the CCD so as to measure the actual display brightness of each sub-pixel). The brightness of each sub-pixel also can be measured in modes of a Complementary Metal Oxide Semiconductor (CMOS) imaging device and the like. The ICON 12, the drive chip 13 and the like can be implemented by corresponding circuits or sub-circuits.

In other words, in the present embodiment, the initial reference voltage corresponding to each sub-pixel has been measured and verified (i.e., has been subjected to optical compensation) by the CCD, and thus, although errors of line capacitors and errors between chip channels still exist, pixel brightness compensation is influenced at all. Thus, each sub-pixel can be subjected to brightness compensation by using the initial reference voltage as a reference value. In the subsequent application processes, when a sensed voltage equivalent to the initial reference voltage is acquired by changing the data voltage, it is believed that uniform compensation is achieved, so that the problem of inaccurate compensation on pixel brightness distortions, which is caused by the errors of the capacitors of column-oriented lines and the errors between the chip channels, can be solved, and uniformity and accuracy of initial compensation and subsequent compensation are improved.

For example, the brightness can include a gray scale or display brightness. At the initial compensation stage, by the ICON 12, the initial data voltage output to each sub-pixel by the drive chip 13 can be regulated, and the data voltage compensation value corresponding to each sub-pixel, when the gray scale of the display panel equals a preset value (e.g., a 64 gray scale, a 128 gray scale, a 192 gray scale or a 225 gray scale and the like) or the brightness of the display panel equals a preset value (e.g., the highest brightness, ½ of the highest brightness, ¼ of the highest brightness or ⅛ of the highest brightness and the like, wherein the highest brightness of the display panel can be determined on the basis of the practical situation of the display panel) and the brightness of all the sub-pixels is uniform and consistent, is acquired.

It should be noted that when a brightness difference value of the actual display brightness of any two sub-pixels in all the sub-pixels is in a preset error allowable range (e.g., when a distortion is smaller than 5%), it is considered that the brightness of all the sub-pixels is uniform and consistent.

For example, for any one sub-pixel, the data voltage compensation value corresponding to the any one sub-pixel can be the first data voltage of the any one sub-pixel when the brightness of all the sub-pixels is uniform and consistent; or, can be a difference value or a proportional value of the first data voltage and the initial data voltage output to the any one sub-pixel by the drive chip 13.

In other words, when the brightness value of the display panel equals the preset value, for any one sub-pixel, not only can an actual data voltage of the sub-pixel be set as the data voltage compensation value corresponding to the sub-pixel when the brightness of all the sub-pixels is uniform and consistent, but also the difference value or the proportional value and the like of the actual data voltage of the sub-pixel when the brightness of all the sub-pixels is uniform and consistent, and the initial data voltage of the sub-pixel can be used as the data voltage compensation value corresponding to the sub-pixel, thereby improving the diversity and flexibility of the data voltage compensation value.

It should be noted that under the condition that the brightness value of the display panel equals the preset value, the data voltage compensation value corresponding to each sub-pixel is obtained when the actual display brightness of all the sub-pixels is uniform and consistent, after that, the TCON 12, for example, also can store the preset value of the brightness of the display panel and the data voltage compensation value of each sub-pixel for subsequent application when the first data voltage is output to the pixel circuit of each sub-pixel by the drive chip 13. The data, for example, is stored in a memory which is independent of the TCON 12 or is stored in a memory integrated into the TCON 12, and these memories can be various types of memories, e.g., volatile or nonvolatile memories.

In addition, it should be noted that under the condition that the brightness value of the display panel equals the preset value, after the initial reference voltage corresponding to each sub-pixel is obtained, the TCON 12, for example, also can store the preset brightness value of the display panel and the initial reference voltage corresponding to each sub-pixel for use at the subsequent compensation stage.

It should be noted that in the embodiment of the present disclosure, the preset value can a random value, i.e., a value for any one preset brightness (e.g., any one preset gray scale or any preset display brightness), the TCON 12 can carry out pixel brightness compensation in the following mode: at the initial compensation stage, the data voltage compensation value corresponding to each sub-pixel when the brightness of all the sub-pixels is uniform and consistent is acquired under the condition that the bright parameter value of the display panel equals the preset value by regulating the initial data voltage output to each sub-pixel by the drive chip 13, the drive chip 13 is controlled to output the first data voltage to the pixel circuit of each sub-pixel according to the data voltage compensation value corresponding to each sub-pixel, the sensed voltage corresponding to each sub-pixel at this stage is acquired by the drive chip 13, and each sensed voltage is set as the initial reference voltage corresponding to each sub-pixel under the condition that the brightness value of the display panel equals the preset value; and at the subsequent compensation stage, by changing the data voltage output to each sub-pixel by the drive chip 13, the sensed voltage corresponding to each sub-pixel is made to be equal to the initial reference voltage corresponding to each sub-pixel when the brightness value of the display panel equals the preset value, so as to achieve uniform compensation on brightness of each sub-pixel at the subsequent compensation stage.

However, if each preset brightness value is subjected to pixel brightness compensation in the above mode, the corresponding initial reference voltages will be repeatedly calculated, so that corresponding operations may be excessively complex and system power consumption may be increased. Thus, in another embodiment of the present disclosure, in order to reduce operation complexity and power consumption, the TCON 12 may carry out brightness compensation in the above mode only for a plurality of preset brightness values (e.g., two or three and the like) so as to obtain multiple groups of standard reference data, and for other brightness values, the data voltage corresponding to each sub-pixel can be obtained in a mode of carrying out the interpolation operation on the basis of the multiple groups of standard reference data so as to implement brightness compensation.

In other words, the ICON 12 further can be used for: at any one moment, when the brightness value of the display panel is determined not to be equal to the preset value (i.e., the brightness value of the display panel is a non-preset value), for any one sub-pixel, carrying out the interpolation operation by utilizing at least two groups of standard reference data related to present, calculating out the data voltage which needs to be output to the pixel circuit of the any one sub-pixel at this stage (when the brightness value of the display panel is the non-preset value), and controlling the drive chip 13 to drive the pixel circuit of the any one sub-pixel according to the calculated data voltage; and Each group of standard reference data related to the any one moment can include: a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value.

It should be noted that the number of groups of the standard reference data referred to in the process of carrying out the interpolation operation can be flexibly set according to the practical situation. For example, the higher the requirement for uniform compensation on brightness of the display apparatus is, the greater the number of groups of the standard reference data referred to is; and the lower the requirement for uniform compensation on brightness of the display apparatus, the smaller the number of groups of the standard reference data referred to is, which are not limited in the embodiment.

In addition, it should be noted that when the brightness value of the display panel is the non-preset value, the standard reference data which is referred to in the process of carrying out the interpolation operation is generally standard reference data of a preset value with the same brightness parameter attribute (e.g., the gray scale or the display brightness) with the non-preset value. For example, when the non-preset value is determined to be equal to the 255 gray scale (e.g., the highest gray scale), the standard reference data which is referred to in the process of carrying out the interpolation operation generally can be standard reference data corresponding to the preset 64 gray scale, 128 gray scale and the like, which is not repeated in the embodiment of the present disclosure.

Furthermore, it should be noted that at any one moment, when the brightness value of the display panel is determined not to be equal to the preset value (i.e., the brightness value of the display panel is the non-preset value), for any one sub-pixel, the standard reference data which is based on in the process of carrying out the interpolation operation and is related to the any one moment can be acquired in real time by the TCON 12.

Optionally, in order to implement real-time acquisition of the standard reference data, two actions of displaying and sensing can be set to be carried out in a time dividing mode. For example, one frame of time can be divided into two parts; one part is used for sensing the data voltage of each sub-pixel when the brightness value of the display panel equals the preset value; and the other part is used for carrying out corresponding displaying in accordance with an actual brightness value (i.e., the non-preset value) of the display panel.

Furthermore, the drive chip 13 in the embodiment of the present disclosure, for example, can include a Digital-to-Analog Converter (DAC) module and an Analog-to-Digital Converter (ADC) module.

The DAC module can be used for outputting the data voltage corresponding to each sub-pixel; for example, at the initial compensation stage, the DAC module can output the corresponding first data voltage to the pixel circuit of each sub-pixel according to control of the TCON 12;

The ADC module can be used for detecting the sensed voltage corresponding to each sub-pixel; and for example, at the initial compensation stage, the ADC module can, according to control of the TCON 12, detect the sensed voltage corresponding to each sub-pixel when the drive chip outputs the first data voltage to the pixel circuit of each sub-pixel according to the data voltage compensation value corresponding to each sub-pixel.

For any one sub-pixel, the sensed voltage corresponding to the any one sub-pixel generally may be a voltage used for the TFT (the drive TFT) in the pixel circuit of the any one sub-pixel to charge the line capacitor, which is not repeated in the embodiment of the present disclosure.

Embodiment I of the present disclosure provides the AMOLED display apparatus. In the technical solution of Embodiment I of the present disclosure, the AMOLED display apparatus can include the TCON and the drive chip. The TCON can be used for: at the initial compensation stage, acquiring the data voltage compensation value corresponding to each sub-pixel when the brightness of all the sub-pixels is uniform and consistent under the condition that the brightness value of the display panel equals the preset value by regulating the initial data voltage output to each sub-pixel by the drive chip, controlling the drive chip to output the first data voltage to the pixel circuit of each sub-pixel according to the data voltage compensation value corresponding to each sub-pixel, acquiring the sensed voltage corresponding to each sub-pixel at this stage by the drive chip, and using each sensed voltage as the initial reference voltage corresponding to each sub-pixel under the condition that the brightness value of the display panel equals the preset value; and at the subsequent compensation stage, by changing the data voltage output to each sub-pixel by the drive chip, making the sensed voltage corresponding to each sub-pixel to be equal to the initial reference voltage corresponding to each sub-pixel when the brightness value of the display panel equals the preset value, so as to achieve uniform compensation on brightness of each sub-pixel at the subsequent compensation stage, wherein the brightness of each sub-pixel is measured by the CCD.

In other words, in the process of carrying out uniform compensation on brightness, a parasitic capacitor (i.e. the line capacitor) on each column-oriented line (e.g., a datum line, a data line and the like) of the display screen is still different and the ADC module still has a conversion error for each channel, i.e., the errors of the line capacitors and the errors between chip channels still exist, however, the initial reference voltage corresponding to each sub-pixel has been measured and verified by the CCD for example, and thus, pixel brightness compensation is not influenced at all, and each sub-pixel can be subjected to brightness compensation by using the initial reference voltage as the reference value. In the subsequent using process, when a sensed voltage which is equivalent to the initial reference voltage is acquired by changing the data voltage, it is believed that uniform compensation is achieved, so that the problem of inaccurate compensation on pixel brightness distortions, which is caused by the errors of the capacitors of column-oriented lines and the errors between the chip channels, can be solved, and uniformity and accuracy of initial compensation and subsequent compensation are improved.

In addition, for any one of other brightness values different from the preset value, the interpolation operation can be carried out on the basis of multiple groups of related standard reference data to obtain the data voltage corresponding to each sub-pixel so as to achieve brightness compensation, and thus, operation complexity and system power consumption also can be reduced on the basis of improving accuracy of pixel brightness compensation.

Embodiment II

Figure 2:
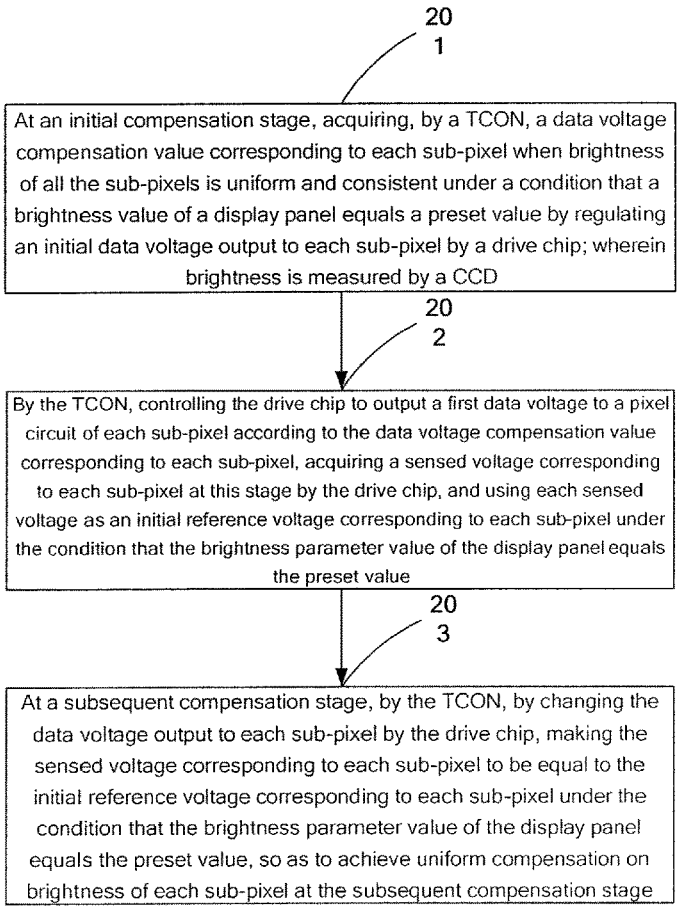
FIG. 2 shows a flow schematic diagram of a brightness compensation method of the AMOLED display apparatus in an embodiment of the present disclosure.

Based on the same inventive concept with Embodiment I of the present disclosure, Embodiment II of the present disclosure provides a brightness compensation method of an AMOLED display apparatus. FIG. 2 is a flow schematic diagram of the brightness compensation method of the AMOLED display apparatus in Embodiment II of the present disclosure. The brightness compensation method may include the following processes:

S201: at an initial compensation stage, by a TCON, acquiring a data voltage compensation value corresponding to each sub-pixel when brightness of all the sub-pixels is uniform and consistent under a condition that a brightness value of a display panel equals a preset value by regulating an initial data voltage output to each sub-pixel by a drive chip, wherein the brightness of each sub-pixel is measured by a CCD.

For example, the brightness may be a gray scale or display brightness. Namely, at the initial compensation stage, by regulating the initial data voltage output to each sub-pixel by the drive chip, the TCON 12 can acquire the data voltage compensation value corresponding to each sub-pixel when the brightness of all the sub-pixels is uniform and consistent under the condition that the gray scale of the display panel equals a preset value (e.g., a 64 gray scale, a 128 gray scale, a 192 gray scale or a 225 gray scale and the like) or the brightness of the display panel equals a preset value (e.g., the highest brightness, ½ of the highest brightness, ¼ of the highest brightness or ⅛ of the highest brightness and the like, wherein the highest brightness of the display panel can be determined on the basis of the practical situation of the display panel).

It should be noted that when a brightness difference value of the actual display brightness of any two sub-pixels in all the sub-pixels is in a preset error allowable range, it is considered that the brightness of all the sub-pixels is uniform and consistent, which is not repeated in the embodiment of the present disclosure.

S202: by the TCON, controlling the drive chip to output a first data voltage to a pixel circuit corresponding to each sub-pixel according to the data voltage compensation value corresponding to each sub-pixel, acquiring a sensed voltage corresponding to each sub-pixel at this stage by the drive chip, and using each sensed voltage as an initial reference voltage corresponding to each sub-pixel under the condition that the brightness value of the display panel equals the preset value.

Optionally, for any one sub-pixel, the data voltage compensation value corresponding to the any one sub-pixel can be the first data voltage of the any one sub-pixel when the brightness of all the sub-pixels is uniform and consistent, or can be a difference value or a proportional value of the first data voltage and the initial data voltage output to the any one sub-pixel by the drive chip.

In addition, for any one sub-pixel, the sensed voltage corresponding to the any one sub-pixel generally can be a voltage used for a TFT (a drive TFT) in the pixel circuit of the any one sub-pixel to charge a line capacitance.

S203: at a subsequent compensation stage, by the TCON, by changing the data voltage output to each sub-pixel by the drive chip, making the sensed voltage corresponding to each sub-pixel to be equal to the initial reference voltage corresponding to each sub-pixel under the condition that the brightness value of the display panel equals the preset value, so as to achieve uniform compensation on brightness of each sub-pixel at the subsequent compensation stage.

In other words, errors of the line capacitors and errors between chip channels still exist, but pixel brightness compensation is influenced at all. The reasons are that the initial reference voltage corresponding to each sub-pixel has been measured and verified by a CCD, and each sub-pixel can be subjected to brightness compensation by using the initial reference voltage as the reference value. In the subsequent application process, when the sensed voltage which is the same with the initial reference voltage is acquired by changing the data voltage, it is believed that uniform compensation is achieved, so that the problem of inaccurate compensation on pixel brightness distortions, which is caused by the errors of the capacitors of the column-oriented lines and the errors between the chip channels, can be solved, and uniformity and accuracy of initial compensation and subsequent compensation are improved.

Optionally, ill order to reduce system power consumption and improve operation simplicity, the method may further include:

At any one moment, when determining that the brightness value of the display panel is one of other values different from the preset value, for any one sub-pixel, carrying out the interpolation operation by utilizing at least two groups of standard reference data related to the any one moment, calculating the data voltage which needs to be output to the pixel circuit of the any one sub-pixel, and controlling the drive chip to drive the pixel circuit of the any one sub-pixel according to the calculated data voltage;

Each group of standard reference data related to the any one moment can include: a corresponding preset value, and the data voltage for making the sensed voltage corresponding to the any one sub-pixel to be equal to the initial reference voltage related to both the corresponding preset value and the any one sub-pixel at the any one moment under the condition that the brightness value of the display panel equals the corresponding preset value.

In other words, for any one of other brightness values different from the preset value, the interpolation operation can be carried out on the basis of multiple groups of related standard reference data to obtain the data voltage corresponding to each sub-pixel so as to achieve brightness compensation, and thus, operation complexity and system power consumption also can be reduced on the basis of improving accuracy of pixel brightness compensation.

It should be noted that the number of groups of the standard reference data referred to in the process of carrying out the interpolation operation can be flexibly set according to practical situations. For example, the higher the requirement for uniform compensation on brightness of the display apparatus is, the greater the number of groups of the standard reference data referred to is; and the lower the requirement for uniform compensation on brightness of the display apparatus is, the smaller the number of groups of the standard reference data referred to is, which are not limited in the embodiment.

In addition, it should be noted that when the brightness value of the display panel is determined to be a non-preset value, the standard reference data which is referred to in the process of carrying out the interpolation operation is generally standard reference data of a preset value with the same brightness parameter attribute (e.g., the gray scale or the display brightness) with the non-preset value. For example, when the non-preset value is determined to be equal to the 255 gray scale (e.g., the highest gray scale), the standard reference data which is referred to in the process of carrying out the interpolation operation generally can be standard reference data corresponding to the set 64 gray scale, 128 gray scale and the like, which is not repeated in the embodiment of the present disclosure.

Furthermore, it should be noted that at any one moment, when the brightness value of the display panel is determined to be different from the preset value (i.e., the brightness value of the display panel is a non-preset value), for any one sub-pixel, the standard reference data which is based on in the process of carrying out the interpolation operation and is related to the any one moment can be acquired in real time by the TCON 12.

Optionally, in order to implement real-time acquisition of the standard reference data, two actions of displaying and sensing can be set to be carried out in a time dividing mode. For example, one frame of time can be divided into two parts; one part is used for sensing the data voltage of each sub-pixel under the condition that the brightness value of the display panel equals the preset value; and the other part is used for carrying out corresponding display in accordance with an actual brightness value (i.e., the non-preset value) of the display panel, which is not illustrated in the embodiment of the present disclosure.

The brightness compensation method in Embodiment II of the present disclosure will be further illustrated in the following by examples.

Example (1)

Assuming that the brightness parameter of the display panel is the gray scale and for any one preset gray scale, the TCON can carry out brightness compensation in the mode described in Embodiment II of the present disclosure, the brightness compensation method can include the following proceedings:

S1: setting the gray scale value of the display panel to be detected, e.g., the 64 gray scale, the 128 gray scale, the 192 gray scale, or the 225 gray scale (the highest gray scale) and the like, controlling the drive chip to output the data voltage to each sub-pixel, photographing a display screen by using the CCD, and measuring the brightness of each sub-pixel;

S2: regulating the data voltage of each sub-pixel one by one, so that the measured brightness of all the sub-pixels is in a required uniform range;

S3: when brightness uniformity of the display screen reaches the requirement, for any one sub-pixel, storing the data voltage of the any one sub-pixel and the corresponding gray scale value into a memory;

S4: for any one sub-pixel, outputting the corresponding stored data voltage to the pixel circuit of the sub-pixel, detecting the voltage, i.e., the sensed voltage, for driving a current of the TFT to charge the line capacitor Cx by an ADC module of the drive chip, and storing the sensed voltage as the initial reference voltage; and

S5: at the subsequent compensation stage, for any one sub-pixel, by changing the data voltage output to the any one sub-pixel by the drive chip, making the sensed voltage corresponding to the any one sub-pixel to be equal to the initial reference voltage corresponding to the any one sub-pixel obtained in the step S4 under the condition that the brightness of the display panel equals the gray scale value, so as to achieve uniform compensation on brightness of each sub-pixel.

Example (2)

Assuming that the brightness parameter of the display panel is the display brightness and the TCON can carry out brightness compensation only for a plurality of preset brightness values (e.g., two brightness values) in the mode in Embodiment II of the present disclosure so as to obtain multiple groups of standard reference data, and can obtain the data voltage corresponding to each sub-pixel for other brightness values in a mode of carrying out the interpolation operation on the basis of the multiple groups of standard reference data so as to implement brightness compensation, the brightness compensation method can include of the following proceedings:

S1: setting preset display brightness of the display panel to be detected, e.g., the highest brightness and ¼ of the highest brightness; and for each preset brightness, controlling the drive chip to output the data voltage to each sub-pixel, photographing the display screen by using the CCD, and measuring the brightness of each sub-pixel;

S2: for each preset brightness, regulating the data voltage of each sub-pixel one by one, so that the measured brightness of each the sub-pixel respectively reaches the preset highest brightness and the preset ¼ of the highest brightness in the error allowable range;

S3: for each preset brightness, when brightness uniformity of the display screen reaches the requirement, for any one sub-pixel, storing the data voltage of the any one sub-pixel and the corresponding preset gray scale value into a circuit;

S4: for each preset brightness and for any one sub-pixel, outputting the corresponding stored data voltage to the pixel circuit of the sub-pixel, detecting the voltage, i.e., the sensed voltage, for driving the current of the TFT to charge the line capacitor Cx by the ADC module of the drive chip, and storing the sensed voltage as the initial reference voltage; and

S5: at the subsequent compensation stage, when the set brightness parameter of the display panel is any one of the preset brightness values, for any one sub-pixel, by changing the data voltage output to the any one sub-pixel by the drive chip, making the sensed voltage corresponding to the any one sub-pixel to be equal to the initial reference voltage corresponding to the any one sub-pixel obtained in the step S4 when the brightness of the display panel equals the preset display brightness, so as to achieve uniform compensation on brightness of each sub-pixel; or At any one moment, when the set brightness parameter of the display panel is any one non-preset brightness value, e.g., the set brightness parameter is ½ of the highest brightness, for any one sub-pixel, carrying out the interpolation operation by utilizing the highest brightness related to the any one moment and the data voltage corresponding to the ¼ of the highest brightness when the brightness compensation is uniform, calculating the data voltage which needs to be output to the pixel circuit of the any one sub-pixel, outputting the data voltage, and carrying out corresponding proceedings so as to achieve uniform compensation on brightness of each sub-pixel.

Furthermore, one example of the method in Embodiment II further can be as follows:

S1: before delivery, for the preset display brightness (e.g., the highest brightness and ¼ of the highest brightness), carrying out optical compensation by utilizing the CCD, and storing the data voltage of each sub-pixel of which the display panel brightness reaches the uniformity requirement and the corresponding preset display brightness into a Flash for example;

S2: operating an initial program and acquiring the initial reference voltages. For example, S2 may include:

S2.1: reading data from the Flash;

S2.2: by a Vgs1/2 calculation unit, calculating a drive voltage Vgs1 corresponding to each sub-pixel at the highest brightness and a drive voltage Vgs2 corresponding to each sub-pixel at ¼ of the highest brightness by utilizing the corresponding data voltage obtained in the step S1, and storing the drive voltage Vgs1 and the drive voltage Vgs2 into the memory (e.g., a DDR (Double Data Rate) memory);

S2.3: at a sensing stage, acquiring the sensed voltage Vsense1 (i.e., a detected value of the ADC module) and the sensed voltage Vsense2 of each column of the display panel respectively by the Vgs1 and the Vgs2, storing the sensed voltage Vsense1 and the sensed voltage Vsense2 as the initial reference voltages of optical compensation into the Flash;

S2.4: inputting the Vgs1 and the Vgs2 into a μ/Vth calculation unit, calculating a migration rate μ and a threshold voltage Vth, and storing obtained results into the DDR memory and the Flash, where μ and Vth are solved in accordance with a formula:

$$I=\tfrac{1}{2}*\mu*(Vgs-Vth)\hat{}2;$$

In the formula, μ and Vth are unknown values, and can be solved by taking the Vgs1 and the Vgs2 into the formula to establish an equation set:

$$I1=\tfrac{1}{2}*\mu*(Vgs1-Vth)\hat{}2;$$

$$I2=\tfrac{1}{2}*\mu*(Vgs2-Vth)\hat{}2.$$

S3: operating a conventional program and carrying out pixel compensation, which for example may include:

S3.1: starting up to read μ and Vth from the Flash; it should be noted that compensation can be carried out in real time at a display stage;

S3.2: according to the μ and the Vth which are obtained in the previous step, calculating the Vgs1 corresponding to each sub-pixel at the highest brightness and the Vgs2 corresponding to each sub-pixel at ¼ of the highest brightness, storing the Vgs1 and the Vgs2 into the DDR memory; and acquiring the Vsense1 and the Vsense2 of each column, which are used as the initial reference voltages;

S3.3: at the sensing stage:

At any one moment, acquiring a Vsense of each sub-pixel respectively by the Vgs1 and the Vgs2, comparing the Vsense with the corresponding initial reference voltages Vsense1 and Vsense2, regulating the Vgs1 and the Vgs2 according to comparison results, updating data in the DDR memory, inputting the updated Vgs1 and Vgs2 in the DDR memory into the μ/Vth calculation unit to obtain the updated μ and vth, and storing the updated μ and Vth into the DDR memory and the Flash;

If the display brightness of the screen is non-preset display brightness, assuming that the display brightness of the screen is ½ of the highest brightness, for any one sub-pixel, at any one moment, the data voltages required by any one sub-pixel can be obtained only by carrying out interpolation calculation according to the Vgs1 and the Vgs2 (according to the Vgs, the corresponding data voltages can be directly solved) at the current moment, so as to achieve uniform compensation on brightness of the display panel.

In other words, in the technical solution of Embodiment II of the present disclosure, in the process of carrying out uniform compensation on brightness, a parasitic capacitor (i.e., the line capacitor) on each column-oriented line (e.g., a datum line, a data line and the like) of the display screen is still different and the ADC module still has a conversion error for each channel, i.e., the errors of the line capacitors and the errors between chip channels still exist. However, the initial reference voltage corresponding to each sub-pixel has been measured and verified by the CCD, and thus, existence of the errors cannot influence pixel brightness compensation at all. Each sub-pixel can be subjected to brightness compensation by using the initial reference voltage as the reference value. In the subsequent using process, when the sensed voltage which is the same with the initial reference voltage is acquired by changing the data voltage, it is believed that uniform compensation is achieved. Therefore, the problem of inaccurate compensation on pixel brightness distortions, which is caused by the errors of the capacitors of column-oriented lines and the errors between the chip channels, can be solved, and uniformity and accuracy of initial compensation and subsequent compensation are improved.

In addition, for any one of other brightness values different from the preset value, the interpolation operation can be carried out on the basis of multiple groups of related standard reference data to obtain the data voltage corresponding to each sub-pixel so as to achieve brightness compensation, and thus, operation complexity and system power consumption also can be reduced on the basis of improving accuracy of pixel brightness compensation.

Those skilled in the art should understand that embodiments of the present disclosure can provide a method, an apparatus (device) or a computer program product. Thus, the present disclosure can adopt forms of full hardware embodiments, full software embodiments or embodiments combining aspects of software and hardware. Moreover, the present disclosure can adopt a form of a computer program product implemented on one or more computer available storage media (including, but not limited to, a disk memory, a CD-ROM (Compact Disc Read Only Memory), an optical memory and the like) including computer available program codes.

The present disclosure is described with reference to flow charts and/or block diagrams of the method, the apparatus (device) and the computer program product according to the embodiments of the present disclosure. It should be understood that each flow and/or block and combinations of the flows and/or the blocks in the flow charts and/or the block diagrams can be implemented by computer program instructions. The computer program instructions can be provided to a general-purpose computer, a special-purpose computer, an embedded processor or processors of other programmable data processing devices so as to generate a machine, so that by the instructions executed by the computer or the processors of other programmable data processing devices, an apparatus for achieving designated functions in one or more flows of the flow charts and in one or more blocks of the block diagrams is generated.

Those computer program instructions also can be stored in a computer readable memory capable of guiding the computer or other programmable data processing devices to work in a specific mode, so that the instructions stored in the computer readable memory generate a product including an instruction apparatus, and the instruction apparatus achieves the designated functions in one or more flows of the flow charts and in one or more blocks of the block diagrams.

Those computer program instructions also can be loaded onto the computers or other programmable data processing devices so as to execute a series of operation steps on the computer or other programmable data processing devices to generate processing implemented by the computer, and thus, the instructions executed on the computer or other programmable devices provide the steps for achieving the designated functions in one or more flows of the flow charts and in one or more blocks of the block diagrams.

What are described above is related to the illustrative embodiments of the disclosure only and not limitative to the scope of the disclosure; the scopes of the disclosure are defined by the claims.

The present application claims the priority of the Chinese Patent Application No. 201510531737.0 filed on Aug. 26, 2015, which is incorporated herein by reference as part of the disclosure of the present application.

The invention claimed is:

1. An Active-Matrix Organic Light Emitting Diode (AMOLED) display apparatus, comprising a display panel, wherein the display panel comprises a plurality of sub-pixels, each sub-pixel comprises an Organic Light Emitting Diode (OLED) and a pixel circuit for independently driving the OLED, and the AMOLED display apparatus further comprises:

a drive chip, configured to output a corresponding data voltage to each sub-pixel and acquire a sensed voltage corresponding to each sub-pixel; and a Timing Controller (TCON), configured to: at an initial compensation stage, acquire a corresponding data voltage compensation value when brightness of all the sub-pixels is uniform and consistent under a condition that a brightness value of the display panel is a preset value, by regulating an initial data voltage output to each sub-pixel by the drive chip, control the drive chip to output a first data voltage to the pixel circuit of each sub-pixel according to the data voltage compensation value corresponding to each sub-pixel, acquire the sensed voltage corresponding to each sub-pixel at this stage by the drive chip, and set each sensed voltage as an initial reference voltage corresponding to each sub-pixel under the condition that the brightness value of the display panel equals the preset value; and at a subsequent compensation stage, by changing the data voltage output to each sub-pixel by the drive chip, make the sensed voltage corresponding to each sub-pixel to be equal to the initial reference voltage corresponding to each sub-pixel under the condition that the brightness value of the display panel equals the preset value, so as to achieve uniform compensation on brightness of each sub-pixel at the subsequent compensation stage; and wherein the brightness of each sub-pixel is measured by an image sensor;

the drive chip includes a Digital-to-Analog Converter (DAC) module and an Analog-to-Digital Converter (ADC) module; the DAC module is configured to output the data voltage corresponding to each sub-pixel; and the ADC module is configured to detect the sensed voltage corresponding to each sub-pixel;

the TCON is further configured to: at any one moment, when the brightness value of the display panel is not equal to the preset value, for any one sub-pixel, carry out an interpolation operation by utilizing at least two groups of standard reference data related to the any one moment calculate the data voltage which needs to be output to the pixel circuit of the any one sub-pixel at the any one moment, and control the drive chip to drive the pixel circuit of the any one sub-pixel according to the calculated data voltage, wherein each group of standard reference data related to the any one moment includes:

a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value;

the standard reference data is acquired in real time by the TCON; the real-time acquisition of the standard reference data comprises: one frame of time is divided into two parts; one part is used for sensing the data voltage of each sub-pixel when the brightness value of the display panel equals the preset value; and the other part is used for carrying out corresponding displaying in accordance with an actual brightness value of the display panel.

2. The AMOLED display apparatus according to claim 1, wherein the brightness includes a gray scale or display brightness.

3. The AMOLED display apparatus according to claim 1, wherein for any one sub-pixel, the data voltage compensation value corresponding to the any one sub-pixel includes:

a first data voltage of the any one sub-pixel when the brightness of all the sub-pixels is uniform and consistent, or a difference value or a proportional value of the first data voltage and the initial data voltage output to the any one sub-pixel by the drive chip.

4. A brightness compensation method of an Active-Matrix Organic Light Emitting Diode (AMOLED) display apparatus, comprising:

at an initial compensation stage, by a TCON, acquiring a data voltage compensation value corresponding to each sub-pixel when a brightness of all the sub-pixels is uniform and consistent under a condition that a brightness value of a display panel is a preset value, by regulating an initial data voltage output to each sub-pixel by a drive chip, controlling the drive chip to output a first data voltage to a pixel circuit corresponding to each sub-pixel according to the data voltage compensation value corresponding to each sub-pixel, acquiring a sensed voltage corresponding to each sub-pixel at this stage by the drive chip, and setting each sensed voltage as an initial reference voltage corresponding to each sub-pixel under a condition that the brightness value of the display panel equals the preset value; and at a subsequent compensation stage, by the TCON, by changing the data voltage output to each sub-pixel by the drive chip, making the sensed voltage corresponding to each sub-pixel to be equal to the initial reference voltage corresponding to each sub-pixel under the condition that the brightness value of the display panel equals the preset value, so as to achieve uniform compensation on brightness of each sub-pixel at the subsequent compensation stage;

wherein the brightness of each sub-pixel is measured by an image sensor;

the drive chip includes a Digital-to-Analog Converter (DAC) module and an Analog-to-Digital Converter (ADC) module; the DAC module is configured to output the data voltage corresponding to each sub-pixel; and the ADC module is configured to detect the sensed voltage corresponding to each sub-pixel;

at any one moment, when the brightness value of the display panel is not equal to the preset value, for any one sub-pixel, carrying out an interpolation operation by utilizing at least two groups of standard reference data related to the any one moment, calculating the data voltage which needs to be output to the pixel circuit of the any one sub-pixel at the any one moment, and controlling the drive chip to drive the pixel circuit of the any one sub-pixel according to the calculated data voltage, wherein each group of standard reference data related to the any one moment includes: a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value;

the standard reference data is acquired in real time by the TCON; the real-time acquisition of the standard reference data comprises: one frame of time is divided into two parts; one part is used for sensing the data voltage of each sub-pixel when the brightness value of the display panel equals the preset value; and the other part is used for carrying out corresponding displaying in accordance with an actual brightness value of the display panel.

5. The method according to claim 4, wherein the brightness includes a gray scale or display brightness.

6. The method according to claim 4, wherein for any one sub-pixel, the data voltage compensation value corresponding to the any one sub-pixel includes:

a first data voltage of the any one sub-pixel when the brightness of all the sub-pixels is uniform and consistent; or a difference value or a proportional value of the first data voltage and the initial data voltage output to the any one sub-pixel by the drive chip.

7. The AMOLED display apparatus according to claim 2, wherein for any one sub-pixel, the data voltage compensation value corresponding to the any one sub-pixel includes:

a first data voltage of the any one sub-pixel when the brightness of all the sub-pixels is uniform and consistent, or a difference value or a proportional value of the first data voltage and the initial data voltage output to the any one sub-pixel by the drive chip.

8. The AMOLED display apparatus according to claim 2, wherein the drive chip includes a Digital-to-Analog Converter (DAC) module and an Analog-to-Digital Converter (ADC) module;

the DAC module is configured to output the data voltage corresponding to each sub-pixel; and the ADC module is configured to detect the sensed voltage corresponding to each sub-pixel.

9. The AMOLED display apparatus according to claim 2, wherein the TCON is further configured to: at any one moment, when the brightness value of the display panel is not equal to the preset value, for any one sub-pixel, carry out an interpolation operation by utilizing at least two groups of standard reference data related to the any one moment, calculate the data voltage which needs to be output to the pixel circuit of the any one sub-pixel at the any one moment, and control the drive chip to drive the pixel circuit of the any one sub-pixel according to the calculated data voltage, wherein each group of standard reference data related to the any one moment includes:

a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value.

10. The AMOLED display apparatus according to claim 3, wherein the TCON is further configured to: at any one moment, when the brightness value of the display panel is not equal to the preset value, for any one sub-pixel, carry out an interpolation operation by utilizing at least two groups of standard reference data related to the any one moment, calculate the data voltage which needs to be output to the pixel circuit of the any one sub-pixel at the any one moment, and control the drive chip to drive the pixel circuit of the any one sub-pixel according to the calculated data voltage, wherein each group of standard reference data related to the any one moment includes:

a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value.

11. The AMOLED display apparatus according to claim 1, wherein the TCON is further configured to: at any one moment, when the brightness value of the display panel is not equal to the preset value, for any one sub-pixel, carry out an interpolation operation by utilizing at least two groups of standard reference data related to the any one moment, calculate the data voltage which needs to be output to the pixel circuit of the any one sub-pixel at the any one moment, and control the drive chip to drive the pixel circuit of the any one sub-pixel according to the calculated data voltage, wherein each group of standard reference data related to the any one moment includes:

a corresponding preset value, and the data voltage for making the sensed voltage corresponding to the any one sub-pixel to be equal to the initial reference voltage related to both the corresponding preset value and the any one sub-pixel at the any one moment when the brightness value of the display panel equals the corresponding preset value.

* * * * *